US007614703B2

(12) United States Patent
Bergin

(10) Patent No.: US 7,614,703 B2
(45) Date of Patent: Nov. 10, 2009

(54) ARMREST CUPHOLDER

(75) Inventor: Peter W. A. Bergin, Rancho Mirage, CA (US)

(73) Assignee: Caddy Products, Inc., Thousand Palms, CA (US)

( * ) Notice: Subject to any disclaimer, the term of this patent is extended or adjusted under 35 U.S.C. 154(b) by 0 days.

(21) Appl. No.: 11/435,029

(22) Filed: May 16, 2006

(65) Prior Publication Data

US 2007/0267910 A1 Nov. 22, 2007

(51) Int. Cl.
*A47C 7/54* (2006.01)

(52) U.S. Cl. ..... 297/411.2; 297/188.14

(58) Field of Classification Search ..... 297/411.23, 297/411.26, 411.46, 188.14, 188.16, 188.18
See application file for complete search history.

(56) References Cited

U.S. PATENT DOCUMENTS

| | | | | |
|---|---|---|---|---|
| 334,756 | A | 1/1886 | Denver | |
| 1,036,421 | A | 8/1912 | Barker | |
| 2,419,412 | A | 4/1947 | McArthur | 155/198 |
| 3,068,048 | A | 12/1962 | Mahon et al. | 297/194 |
| 3,074,762 | A | 1/1963 | Kris | 297/416 |
| 3,118,704 | A | 1/1964 | Meserve | 297/194 |
| 3,137,527 | A | 6/1964 | Hoven et al. | 297/412 |
| 3,170,729 | A | 2/1965 | Grant | 297/440 |
| 4,262,962 | A * | 4/1981 | Yust | 297/188.18 |
| 4,521,056 | A | 6/1985 | Lindenmuth | 297/412 |
| 4,795,211 | A | 1/1989 | Stern et al. | 297/194 |
| 5,074,617 | A | 12/1991 | Maxwell | 297/194 |
| 5,234,251 | A | 8/1993 | Ayotte | 297/194 |
| 5,302,000 | A * | 4/1994 | Ayotte | 297/188.14 |
| 5,320,406 | A * | 6/1994 | North | 297/188.14 |
| D350,259 | S | 9/1994 | Ayotte | D7/620 |
| D353,289 | S | 12/1994 | Ayotte et al. | D6/510 |
| 5,395,085 | A * | 3/1995 | Mann | 248/311.2 |
| D365,250 | S | 12/1995 | Bergin et al. | D7/620 |
| 5,478,137 | A * | 12/1995 | Olson et al. | 297/411.26 |
| 5,533,782 | A * | 7/1996 | Goldman | 297/188.18 |
| 5,628,103 | A | 5/1997 | Ayotte et al. | 29/525.01 |
| 6,283,551 | B1 * | 9/2001 | Bergin | 297/411.35 |

* cited by examiner

*Primary Examiner*—Sarah B McPartlin
(74) *Attorney, Agent, or Firm*—Westman, Champlin & Kelly, P.A.; Z. Peter Sawicki

(57) ABSTRACT

An arm attachment for use with a seat having an arm includes a main body having an armrest portion and a container holder at a distal end. A left wall and a right wall extend from the main body proximate the distal end and the container holder portion. A bottom insert extends substantially the length of the armrest portion and has a front end that frictionally engages the left wall and the right wall to retain the bottom insert to the main body where the main body and the bottom insert form a cavity for position in the arm attachment about the arm of the seat.

10 Claims, 5 Drawing Sheets

ARMREST CUPHOLDER

BACKGROUND OF THE INVENTION

The present invention relates to an armrest that can be mounted on the arm or standard of a seat. In particular, the present invention relates to an armrest having a container holder in which the armrest can be removed and replaced.

In stadiums, arenas and theaters, a common problem is the lack of a place to rest beverage or popcorn containers. Often, containers are placed on the floor or on the arm of a seat only to be accidentally knocked over or otherwise spilled. In the alternative, the occupant of a seat must hold the containers, thereby restricting the use of his/her hands.

A number of container holders have been used to alleviate the problem mentioned above. One type of container holder is mounted on the back of a seat to hold the container of the occupant of the seat directly behind. A second type of container holder is adapted to be mounted on the arm or standard of a seat.

SUMMARY OF THE INVENTION

The present invention includes an arm attachment for use with a seat having an arm. The arm attachment includes a main body having an armrest portion and a container holder at a distal end. A left wall and a right wall extend from the main body proximate the distal end. A bottom insert extends substantially the length of the armrest portion and has a front end that frictionally engages the left wall and the right wall to retain the bottom insert to the main body where the main body and the bottom insert form a cavity for positioning the arm attachment about the arm of the seat.

DETAILED DESCRIPTION OF THE PREFERRED EMBODIMENTS

Figure 1:
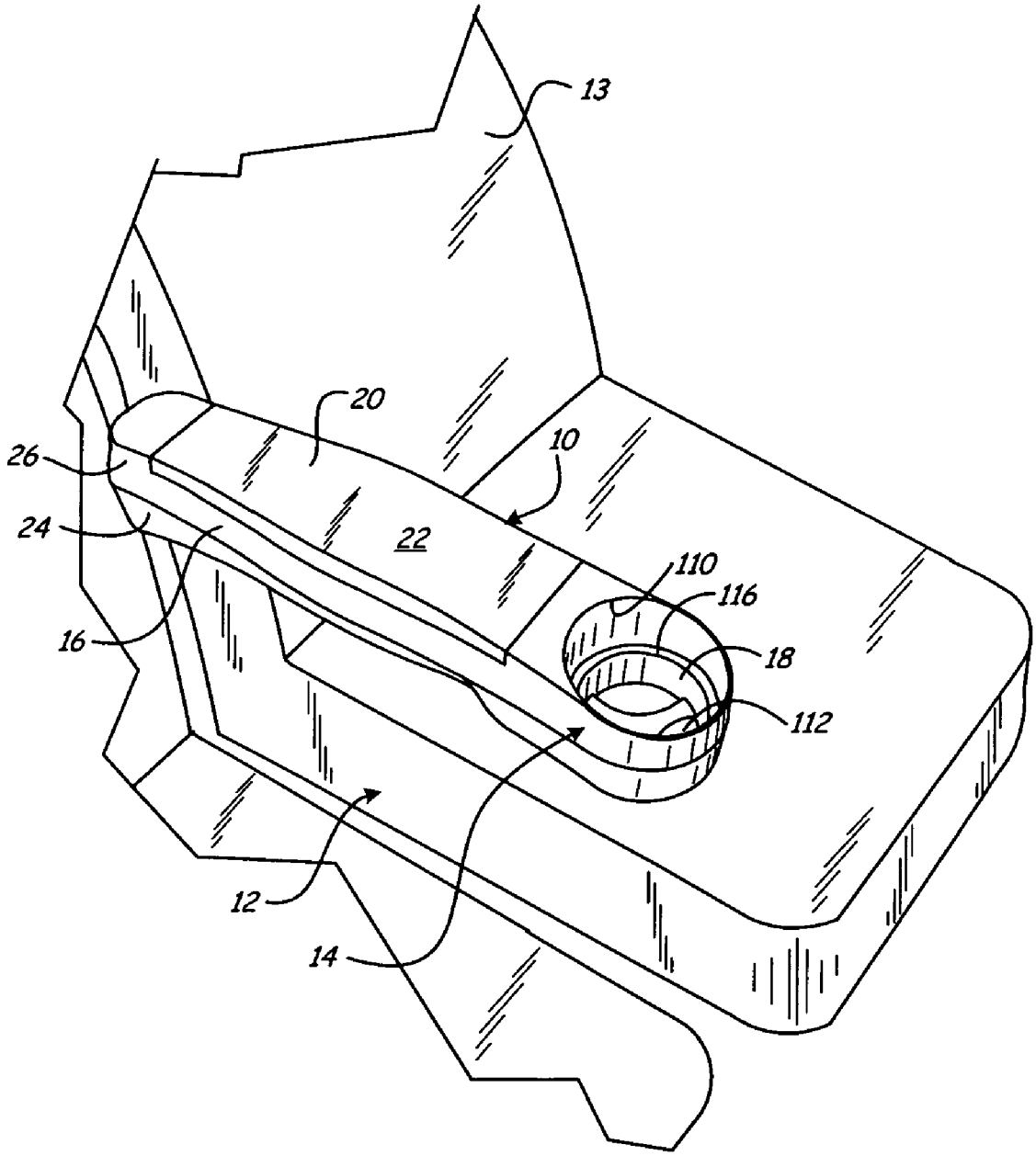
FIG. 1 is a perspective view of a seat with the arm attachment of the present invention mounted thereon.

An armrest cup-holder of the present invention is generally illustrated in FIG. 1 at 10. The armrest cup-holder 10 attaches to a standard or arm of a chair 12. The armrest cupholder 10 includes a main body 14 having an armrest insert portion 16 and a container holder 18. The armrest insert portion 16 includes a length of the armrest cupholder 10 extending from a proximal end 26 to proximate the container holder 18.

Figure 2:
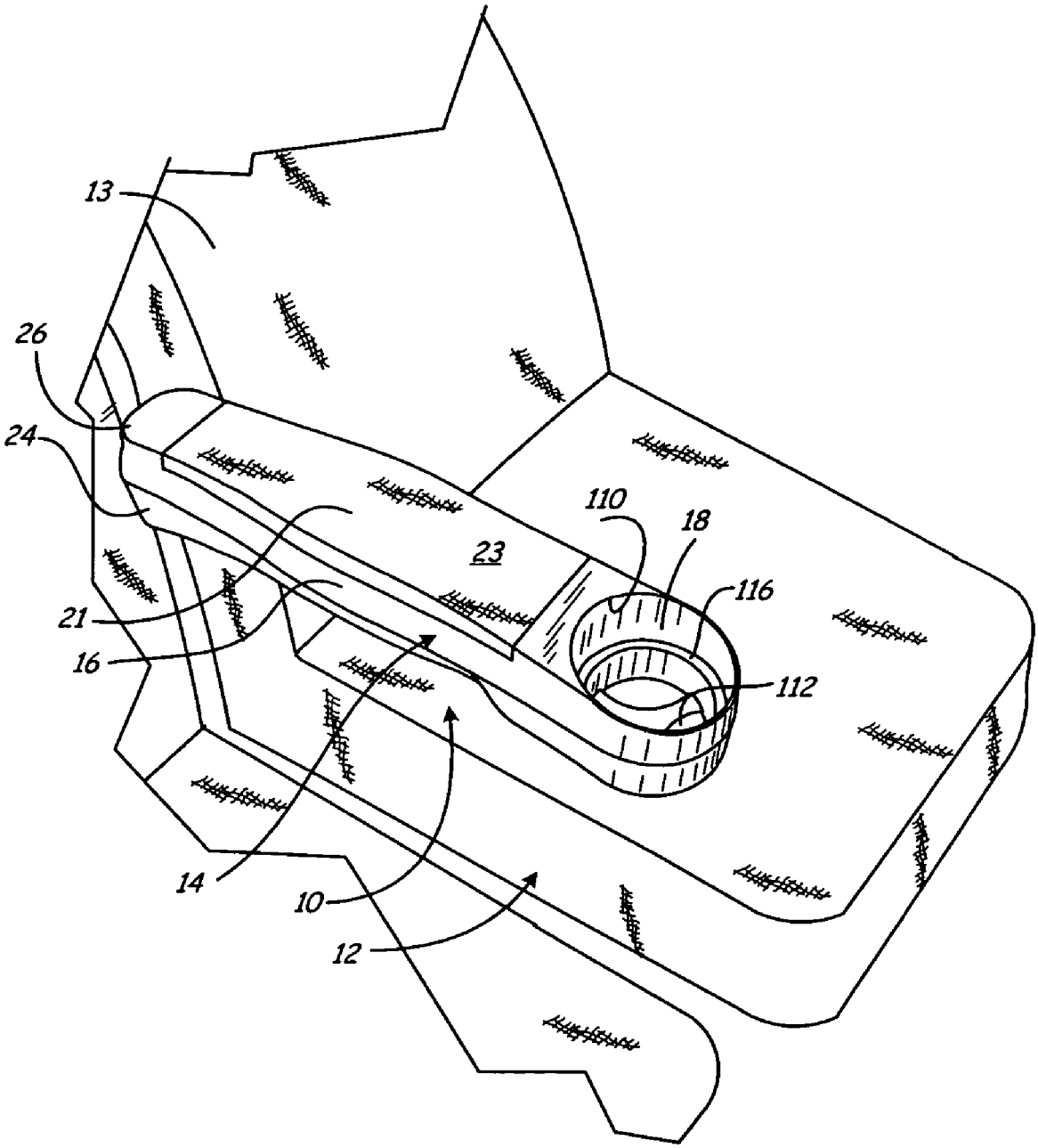
FIG. 2 is a perspective view of the seat with another embodiment of the arm attachment of the present invention mounted thereon.

An unpadded armrest insert 20 is attached to the armrest insert portion 16 of main body 14. The same armrest cupholder 10 is illustrated in FIG. 2 with a cloth covered and padded armrest insert 21. The unpadded armrest insert 20 and the unpadded armrest insert 21 provide an unpadded upper surface 22 and a padded upper surface 23, respectively, for supporting an arm of a user.

A bottom insert 24 attaches to the main body 14 and extends from a proximal end 26 to proximate the container holder 18. The bottom insert 24 and the main body 14 form a cavity that extends substantially along a length of the armrest insert support portion 16. The armrest cup-holder 10 is positioned about the standard or arm of the chair 12 by aligning the cavity with the standard or arm of the chair 12 and moving the proximal end 26 of the armrest cup-holder 10 toward a back 13 of the chair 12.

Figure 4:
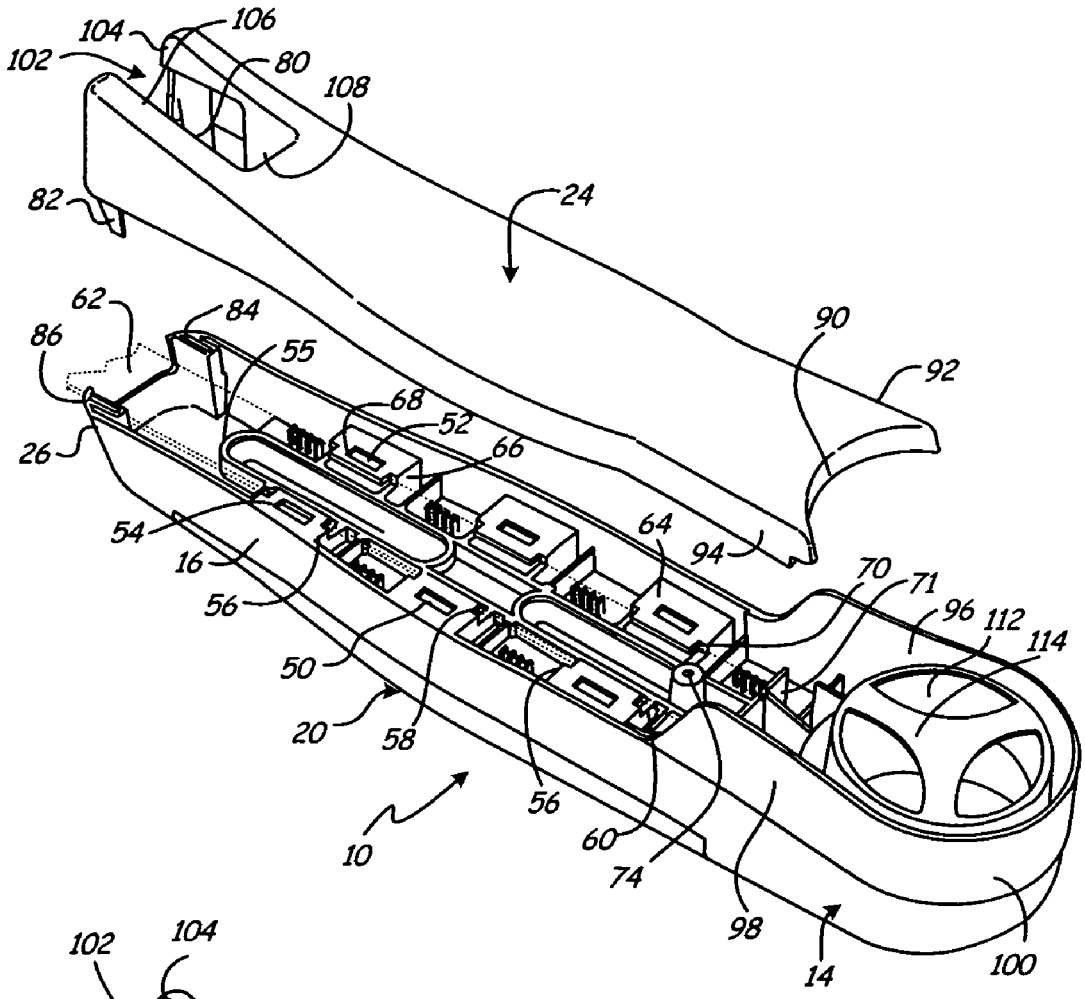
FIG. 4 is another partial exploded view of the arm attachment of the present invention.
Figure 6:
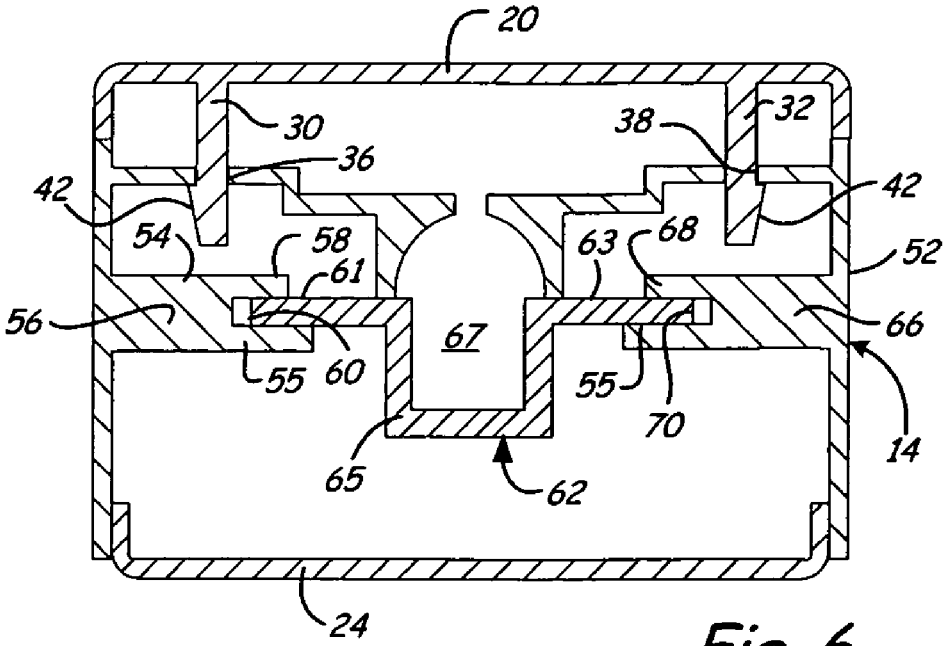
FIG. 6 is a sectional view the arm attachment positioned about the arm of the seat.

Referring to FIGS. 4 and 6, the standard 62 typically includes left and right side portions 61, 63, respectively that are separated by a substantially U shaped middle portion 65 that defines a channel 67. Other configurations of the standard 62 are within the scope of the present invention including, but not limited to a standard having a substantially flat upper surface.

As the armrest cupholder 10 is positioned about the standard 62, the left and right side portions 61, 63 engage left and right channels 60, 70, respectively, extending from the main body 14. The left channel 60 is defined by an outer portion 58 of a wall 54 that is separated from the main bottom surface 55 by side walls 56. The right channel 20 is defined by an outer portion 68 of a wall 64 that is separated from the main bottom surface 35 by sidewalls 66. With the left and right side portions 61, 65 of the standard or arm 62 positioned within the left and right channels 60, 70, respectively, lateral and vertical movement of the main body 14 on the standard or arm 62 is limited. Typically the left and right channels 60, 70 include three separated segments. However, an uninterrupted channel or a channel with two or more segments are within the scope of the present invention.

By lateral movement is meant horizontal movement substantially perpendicular to an axis along the length of the standard. By vertical movement is meant upward or downward movement substantially perpendicular to an axis along the length of the standard.

The armrest cupholder 10 is positioned about the standard 62 until an end of the standard 62 engages a substantially vertical wall 71 extending from a bottom surface 55 of the main body 14. The substantially vertical wall 71 is positioned between the left and right channels 61, 63, respectively, where the substantially vertical wall 71 provides a stopping mechanism that quickly and accurately positions the armrest cupholder 10 onto the standard 62 such that a through bore 74 in a housing extending from the main body 14 aligns positions within the channel 67 in the standard 62 and aligns with an aperture 75 in the standard 62.

Figure 3:
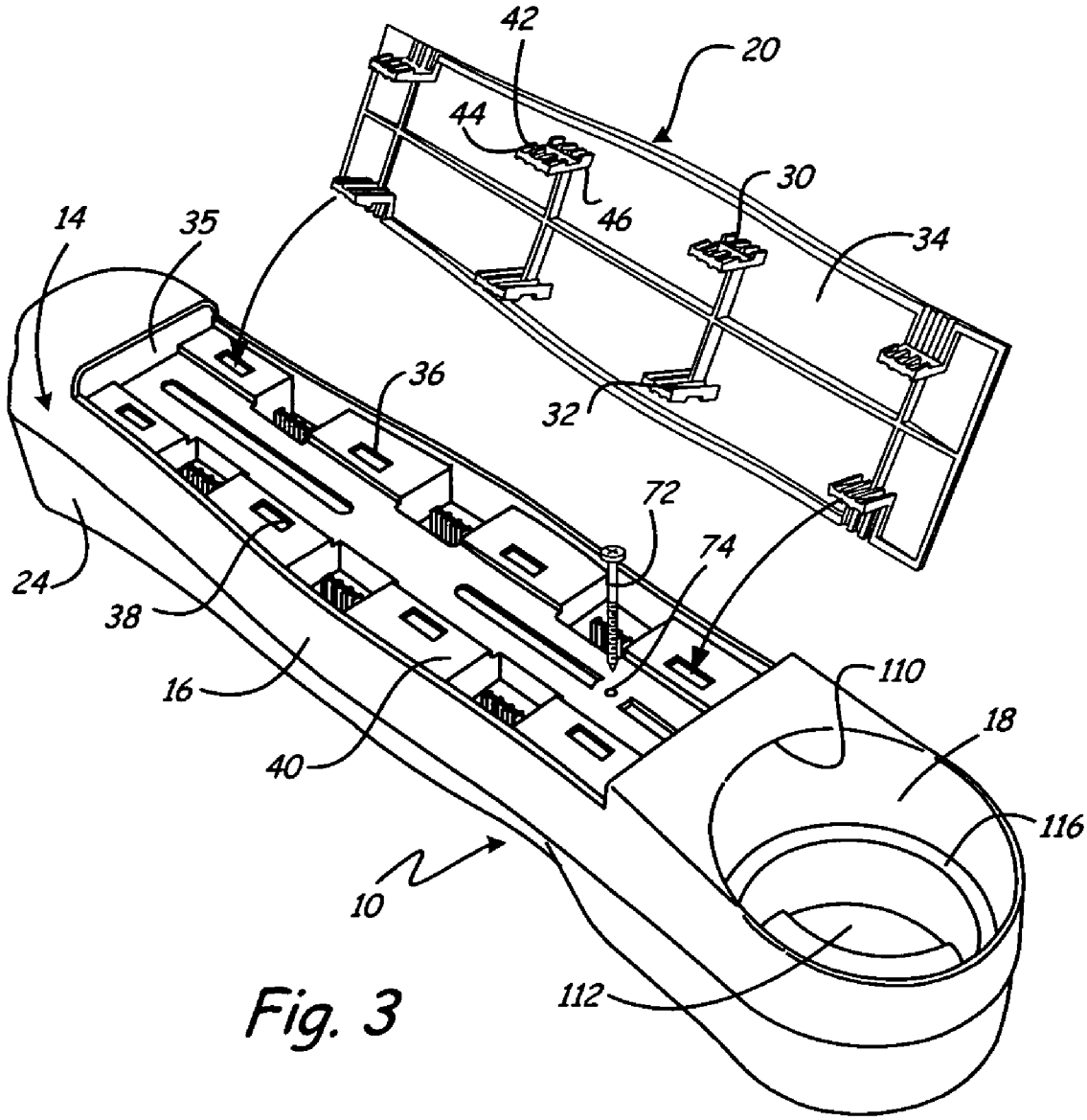
FIG. 3 is a partial exploded view of the arm attachment of the present invention.
Figure 5:
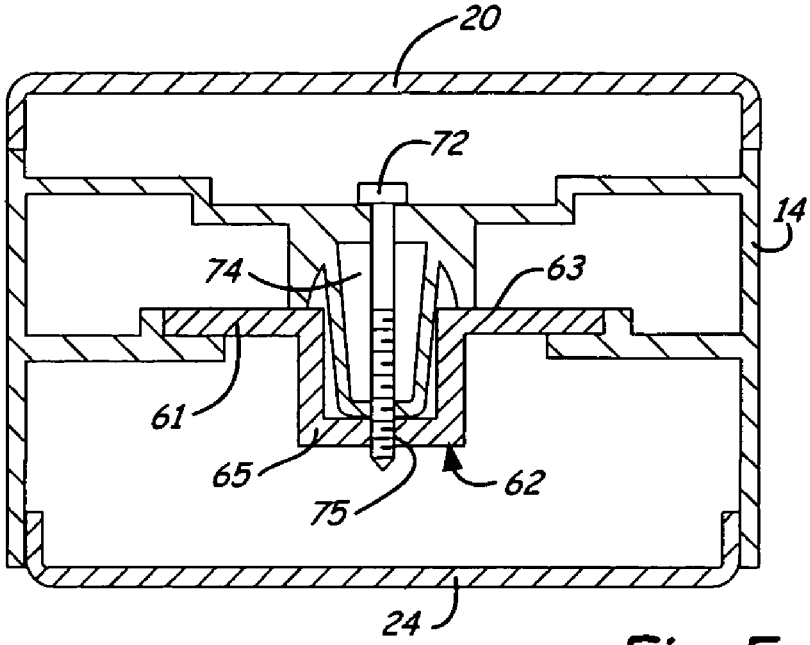
FIG. 5 is a sectional view of the arm attachment attached to the arm of the seat.

Referring to FIGS. 3 and 5, the main body 14 is secured to the standard or arm 62 by inserting a screw 72 through the through bore 74 in the main body 14 and engaging a surface defining the aperture 75 in the standard 62. Utilizing a screw 72 as a fastening mechanism allows the armrest cupholder 10 to be removed from the standard or arm 62 by removing the armrest insert 20 from the main body 14 and disengaging the screw 72 from the standard or arm 62.

With the screw 72 removed the standard or arm 62, the main body 14 is moved in a direction substantially parallel to an axis along the length of the standard 62 such that the channels 60, 70 disengages the left and right sides positions 61, 63 of the standard 62, and thereby allowing the armrest cupholder 10 to be easily replaced when worn or damaged. While a screw 72 is a preferred fastening mechanism for attaching the main body 14 to the standard or arm 62, other fastening mechanisms are within the scope of the present invention including a bolt and nut, a pin and an adhesive.

The armrest insert 20 is removably attached to the main body 14 to provide access to the screw 72 such that the armrest cupholder 10 can be easily removed from the standard 62. Typically the armrest insert 20 is removably secured to the main body 14 by inserting set of left and right tabs 30, 32 extending from the armrest inserted into sets of left and right slots 36, 38, respectively, in an upper surface 40 of the armrest insert portion 16. Each tab 30, 32 has a ramped outer surface 42 where the outer surface 42 is thinner at an end 44 and gradually thickens.

The tabs 30, 32 are positioned into the slots 36, 38, respectively such that grooves 42 in each tab 30, 32 align with the slots 36, 38. With the grooves 42 aligned with the slots 36, 38, the armrest insert 20 is positioned within a recess 35 in the main body 14 such that the main body 14 and the armrest insert 20 or 21 form a substantially uninterrupted top surface.

Figure 4A:
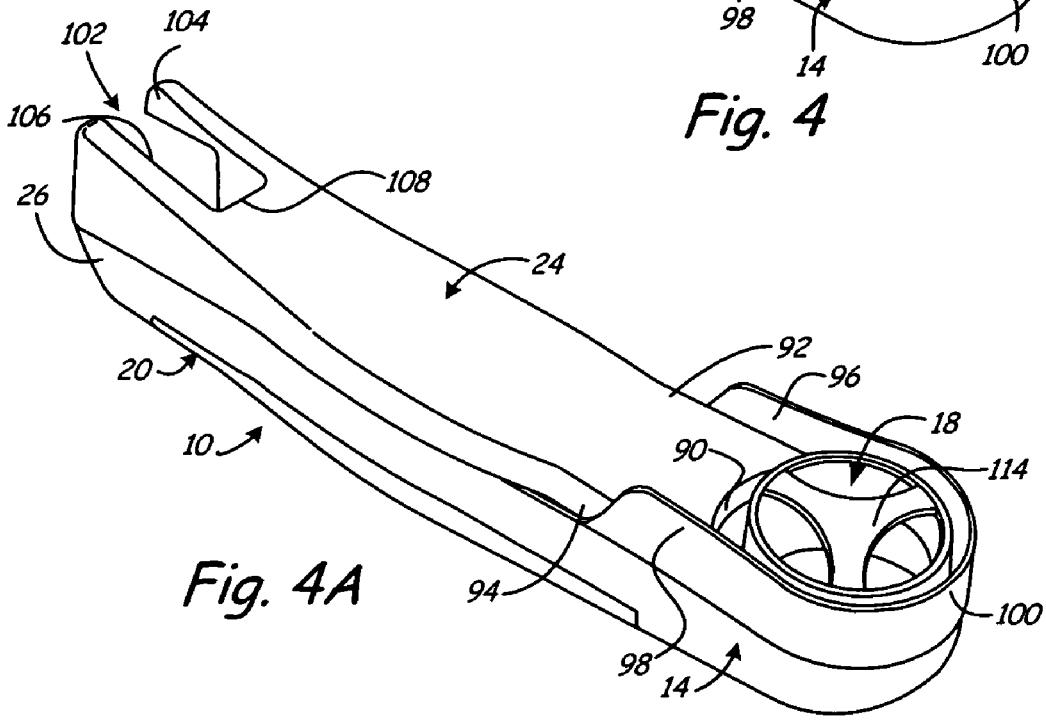
FIG. 4A is a perspective view of the arm attachment of the present invention.

Referring to FIGS. 4 and 4A, a distal end 90 of the bottom insert 24 includes an arcuate surface that is substantially concentric with a perimeter of the cup holder 18. The distal end 90 includes left and right side walls 92, 94 that frictionally engage left and right wall portion 96, 98 extending from a perimeter of the main body 14 and about the cup holder 18. The left and right wall portions 96, 98 are connected with a central arcuate portion 100 that also extends from a perimeter of the main body 14 and about the cup holder 18. The frictional engagement of the left and right side walls 92, 94 with the left and right wall portions 96, 98, respectively, forces the left and right wall portions 96, 98 apart from each other and provides rigidity to the distal end of the armrest cup holder 10 and secures the distal end 90 of the bottom insert 24 to the main body 14.

The bottom insert 24 is also secured to the main body 14 by inserting three sets of opposing left and right tabs (not shown) into three sets of left and right slots 50, 52, respectively. The left and right tabs (not shown) extending from the armrest insert 20 and have a ramped outer surface with a groove for engaging the surface defining the slots 50, 52 to retain the bottom insert 24 to the main body 14.

The bottom insert 24 is further to the main body 14 by inserting left and right extensions 80, 82 into left and right slots 84, 86, respectively, in the main body 14 at the proximal end 26. The engagement of the extensions 80, 82 with surfaces defining the slots 84, 86 secures the proximal end of the bottom insert 24 to the proximal end of the main body 14 and prevents movement of the bottom insert 24 with respect to the main body 14 at the proximal ends.

The proximal end of the bottom insert 24 includes a channel 102 having left, right and back sidewalls 104, 106 and 108, respectively, that position about a back portion of the standard 62. The channel 102 allows the armrest cupholder 10 to substantially conceal the standard or arm 62 from view.

Referring to FIGS. 1, 2 and 4, the container holder 18 is integrally molded at the distal end of the main body 14 and has the general shape of a cylinder. The container holder 18 is open at a top end 110 and includes an opening at a bottom end 112 that has three arcuate shaped ribs 114 at the bottom end to retain a container. The openings at the bottom end 112 allow the cup holder 18 to drain when liquid is spilled into the container holder 18. The container holder 18 also includes a shoulder 116 between the top end 110 and the bottom end 112 to allow the cup holder 18 to snuggly accept containers of different sizes.

The main body 14, the armrest insert 20 and the bottom insert 24 are constructed from a polymeric material through an injection molding process. However, other materials of construction and other processes may be utilized to construct the main body 14, the armrest insert 20 and the bottom insert 24.

Although the present invention has been described with reference to preferred embodiments, workers skilled in the art will recognize that changes may be made in form and detail without departing from the spirit and scope of the invention.

What is claimed is:

1. An arm attachment for use with a seat having an arm, the arm attachment comprising:

a main body having an armrest portion and a container holder proximate a distal end thereof and the container holder having a perimeter, the main body having a left wall and a right wall each extending from the distal end of the main body;

a bottom insert that attaches to the main body and extends substantially the entire length of the armrest portion and having a front end comprising an arcuate front surface that is substantially concentric with the perimeter of the container holder and that frictionally engages the left wall and the right wall on inwardly facing surfaces to retain the bottom insert to the main body and wherein the main body and the bottom insert form a cavity for positioning the arm attachment about the arm of the seat; and the bottom insert further having a back end that comprises a channel having left, right, and back sidewalls for positioning about a back portion of the arm of the seat.

2. The arm attachment of claim 1 and wherein the bottom insert further comprises left and right extensions extending from a back end thereof.

3. The arm attachment of claim 2 and wherein the main body comprises left and right slots proximate a proximal end thereof and wherein the left and right extensions position within the left and right slots to retain the back end of the bottom insert to the proximal end of the main body.

4. The arm attachment of claim 1 and wherein the main body further comprises an arcuate front wall that connects the left wall and the right wall.

5. The arm attachment of claim 1 and wherein the main body further comprises a recess between the container holder and the proximal end thereof.

6. The arm attachment of claim 5 and further comprising an armrest insert for removably positioning within the recess of the main body.

7. The arm attachment of claim 6 and wherein the armrest insert comprises a fabric covering.

8. The arm attachment of claim 6 and wherein the main body includes a first plurality of slots in the recess and the armrest insert includes a first plurality of tabs for positioning in the first plurality of slots to retain the insert to the main body.

9. The arm attachment of claim 1 and wherein the main body includes a second plurality of slots between the container holder and a proximal end and the bottom insert includes a second plurality of tabs for positioning in the second plurality of slots to retain the bottom portion to the main body.

10. The arm attachment of claim 1 and further comprising a fastening mechanism for securing the main body to the arm of the seat.

* * * * *